United States Patent [19]

Whitmyer et al.

[11] 4,448,001

[45] May 15, 1984

[54] MOISTURE DAM SYSTEM FOR CURTAIN WALLS

[75] Inventors: Wayne E. Whitmyer, Buchanan; Thomas E. Matthews, Niles, both of Mich.

[73] Assignee: Kawneer Company, Inc., Norcross, Ga.

[21] Appl. No.: 407,777

[22] Filed: Aug. 13, 1982

[51] Int. Cl.[3] ..... E06B 7/14

[52] U.S. Cl. ..... 52/209; 52/235; 52/302

[58] Field of Search ..... 52/204, 209, 304, 302, 52/235, 15; 49/471, 408

[56] References Cited

U.S. PATENT DOCUMENTS

| | | | |
|---|---|---|---|
| 1,722,172 | 7/1929 | Benson | 52/209 |
| 2,733,487 | 2/1956 | Haack | 49/408 |
| 2,791,011 | 5/1957 | Heep | 52/209 |
| 3,081,849 | 3/1963 | Hubbard | 189/34 |
| 3,147,518 | 9/1964 | Horgan | 52/235 |
| 3,527,012 | 9/1970 | Hemminger | 52/665 |
| 3,719,014 | 3/1973 | Sukolics | 52/235 |
| 3,782,064 | 1/1974 | Hubbard et al. | 52/97 |
| 3,797,191 | 3/1974 | Sukolics | 52/664 |
| 4,070,806 | 1/1978 | Hubbard | 52/95 |
| 4,114,330 | 9/1978 | Sukolics | 52/200 |
| 4,276,729 | 7/1981 | Shiga | 52/209 |
| 4,327,532 | 5/1982 | Matthews | 52/92 |

FOREIGN PATENT DOCUMENTS

| | | | |
|---|---|---|---|
| 1052184 | 4/1979 | Canada | 49/408 |
| 92480 | 1/1962 | Denmark | 52/209 |
| 2461508 | 7/1975 | Fed. Rep. of Germany | 52/209 |
| 649453 | 11/1962 | Italy | 52/209 |

*Primary Examiner*—Henry E. Raduazo

*Attorney, Agent, or Firm*—Mason, Kolehmainen, Rathburn & Wyss

[57] ABSTRACT

A moisture control dam system for curtain wall structures including spaced apart vertical and horizontal members in a framework for supporting wall panels. The horizontal frame members have an upwardly opening channel for receiving a lower edge portion of the panels and the channel includes an upstanding outer wall, a spaced apart upstanding inner wall, and a bottom wall. The upstanding walls are provided with thickened ribs on the inside surfaces adjacent the upper edges and sealing strips are mounted on the ribs for providing moisture seal around the edges of the outside face of the panel. Each rib projects outwardly of the adjacent inside wall surface toward a rib on an opposite channel wall and a pair of vertical grooves are formed therein adjacent the ends of the horizontal frame member for receiving vertical dams of sheet material that are inserted therein to dam up any accumulated moisture in the channel and prevent the discharge thereof out the end of the frame member. Weep openings are provided at appropriate intervals in the outer wall of the horizontal frame member to drain collected moisture to the outside of the building.

11 Claims, 6 Drawing Figures

MOISTURE DAM SYSTEM FOR CURTAIN WALLS

BACKGROUND OF THE INVENTION

1. Field of the Invention

The present invention relates to a new and improved moisture control dam system for curtain walls and the like and more particularly, to a moisture control dam system which prevents the concentration of infiltrating water into large amounts even though the water may leak in from many different places in the curtain wall structure. The dam system is designed to reduce the length of the path of travel of infiltrating water from the point of infiltration until the water is discharged or weeps out in a controlled manner to the outside of the curtain wall structure.

2. Description of the Prior Art

U.S. Pat. No. 3,719,014 discloses a curtain wall system which employs end cap elements mounted at the end of horizontal frame members for preventing the discharge of accumulated moisture into other areas of the curtain wall framework. Other types of wall and skylight systems such as those shown in U.S. Pat. Nos. 4,114,330 and 4,070,806 provide an internal drainage system for systematically collecting and accumulating any infiltrating moisture and subsequently directly the moisture considerable distances along members of the framework until finally, the moisture is discharged to the outside.

OBJECTS AND ADVANTAGES OF THE PRESENT INVENTION

It is an object of the present invention to provide a new and improved moisture control, dam system for curtain walls and the like and more particularly, a new and improved moisture control dam system which tends to minimize the length of travel path of infiltrated water between the point of infiltration until discharge to the outside of the building wall structure.

Yet another object of the present invention is to provide a new and improved moisture control dam system which prevents and avoids the accumulation of large volumes of moisture which may have infiltrated into the structure in relatively small amounts from many different locations.

Another object of the present invention is to provide a new and improved moisture control dam system which is designed to discharge accumulated moisture to the outside of the wall structure at a point positioned as close as possible to the areas of infiltration or entry into the building structure.

Another object of the present invention is to provide a new and improved moisture control dam system which is relatively easy to install and which is not as vulnerable to careless workmanship as in previous systems.

Still another object of the present invention is to provide a new and improved moisture control dam system which does not require the use of screw fasteners or other special clips or the like.

Yet another object of the present invention is to provide a new and improved moisture control dam system wherein the installation of the dams for preventing unwanted transfer of infiltration moisture is greatly facilitated.

Yet another object of the present invention is to provide a new and improved moisture control dam system wherein horizontal frame members are provided with specially designed, deformable ribs, which ribs are subsequently vertically grooved by the insertion of a moisture control dam adjacent the end of the member.

Still another object of the present invention is to provide a new and improved curtain wall moisture control system which a includes a gutter for the collection of any internal condensation which is developed on internal surfaces of the curtain wall structure or panels supported thereby.

SUMMARY OF THE INVENTION

The foregoing objects and advantages of the present invention are accomplished in an illustrated embodiment comprising a new and improved moisture control dam system for a curtain wall structure employing spaced apart, vertical and horizontal frame members providing a framework for supporting panels such as glass which are sealed on the outside face around their periphery with the supporting frame members. The horizontal frame members have an upwardly opening channel provided for receiving a lower edge portion of the wall panels and these channels include an upstanding outer wall, an upstanding inner wall spaced therefrom and a bottom wall. Thickened ribs are integrally formed along the facing inside surfaces of the opposite upstanding walls adjacent the upper edge thereof and these ribs are adapted to engage and support resilient sealing elements inserted around the peripheral edge of the panels. Each rib projects outwardly of an adjacent lower inside wall surface facing toward the rib on the opposite channel wall. In order to support a dam structure at the end of a frame member, vertical grooves are formed in the ribs at desired locations. Rectangular shaped, vertical dams formed of thin sheet metal are then inserted into these grooves in the ribs to provide dams transversely spanning the channel for damming up any accumulated moisture that may be collected and preventing the discharge thereof out through the end of the horizontal frame member into other zones or portions of the curtain wall frame system. The collected moisture is discharged to the outside of the building structure through suitable weep openings drilled in the outer upstanding wall of the horizontal member at appropriate intervals.

BRIEF DESCRIPTION OF THE DRAWINGS

For a better understanding of the present invention, reference should be had to the following detailed description taken in conjunction with the drawings, in which.

DESCRIPTION OF THE PREFERRED EMBODIMENT

Figure 1:
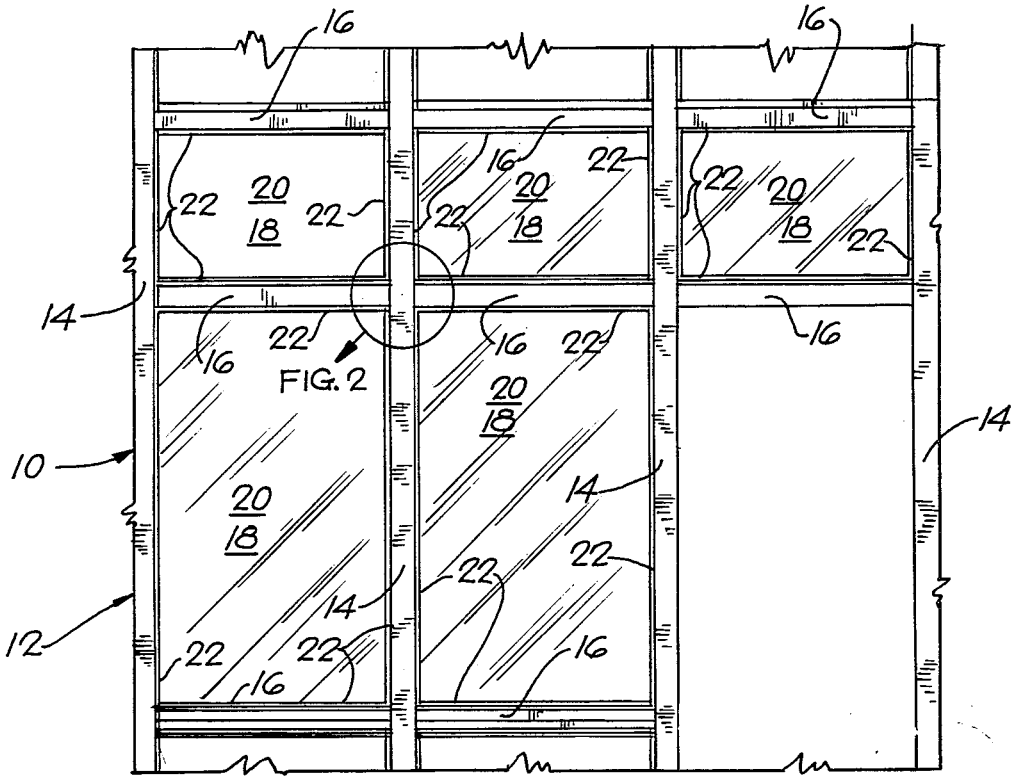
FIG. 1 is a front elevational view of a curtain wall structure having a moisture control dam system installed therein in accordance with the features of the present invention.
Figure 5:
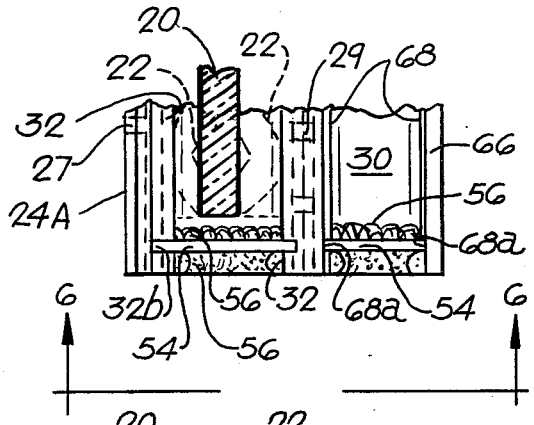
FIG. 5 is a fragmentary, horizontal, cross-sectional view similar to FIG. 4 illustrating an embodiment of the invention designed for use in a wall structure employing single thickness glazing panels.
Figure 6:
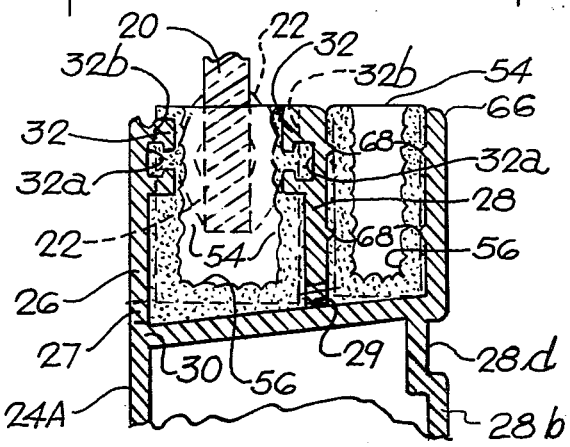
FIG. 6 is a fragmentary, vertical, cross-sectional view taken substantially along lines 6—6 of FIG. 5.
Figures 2, 3:
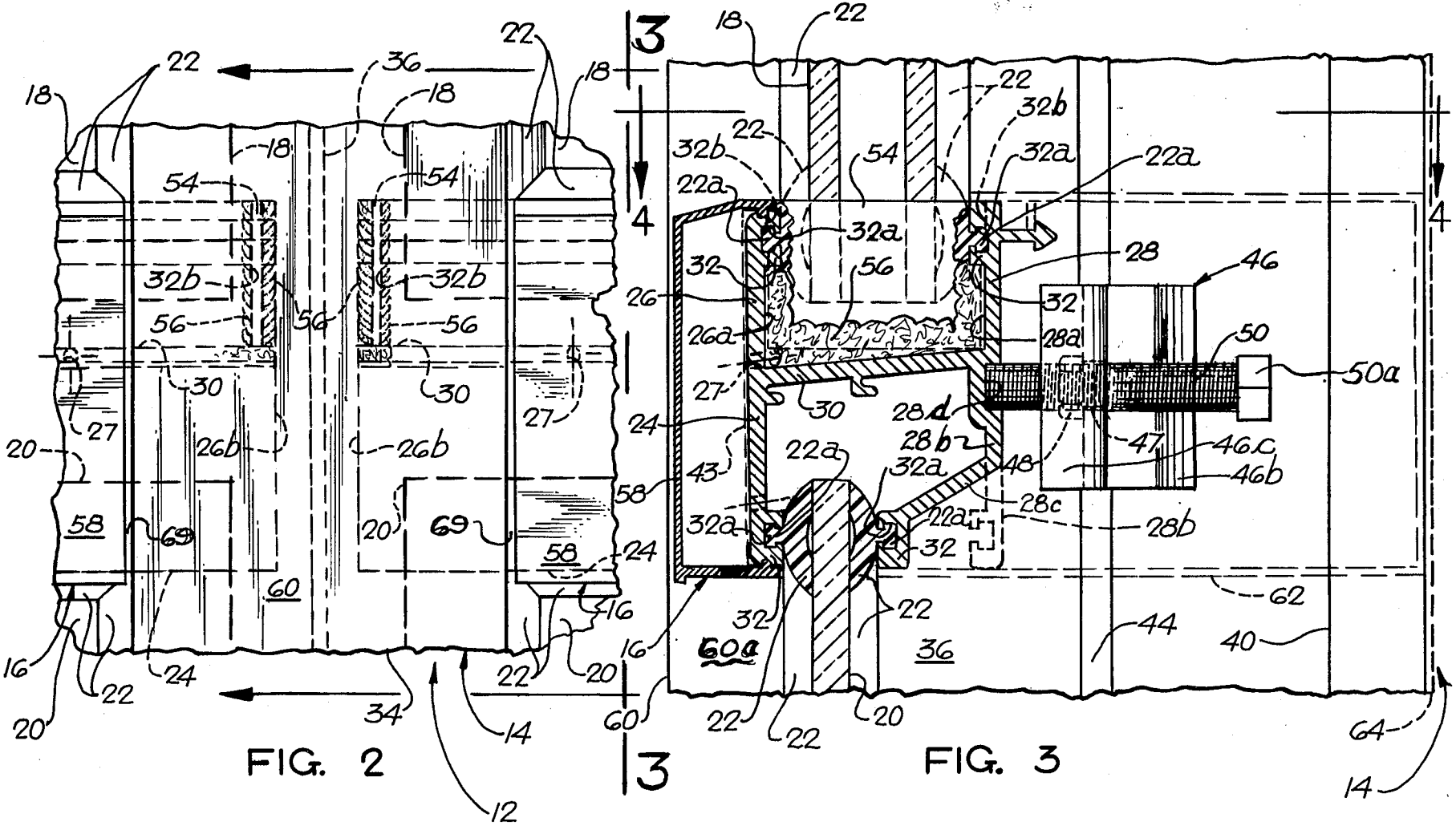
FIG. 2 is an enlarged, fragmentry, elevational view of the curtain wall structure of FIG. 1 illustrating in detail, a junction area between intersecting vertical mullions and horizontal frame members.
FIG. 3 is a fragmentary, vertical, cross-sectional view taken substantially along lines 3—3 of FIG. 2.

Referring now more particularly to the drawings, in FIG. 1 is illustrated an elevational view of a curtain wall structure having a new and improved moisture control dam system in accordance with the present invention installed therein. The curtain wall structure is generally referred to by the reference numeral 10 and includes a framework 12 formed of aluminum extrusions comprising vertical mullions 14 and horizontal frame members 16 which are interconnected to define relatively large, rectangular, panel openings for receiving wall panels such as glass panels 18 of the insulating type, employing a pair of spaced apart glass panes and/or single thickness glazing panels 20 as illustrated in FIGS. 3, 5 and 6.

Elongated sealing strips or glazing weatherstrips 22 formed of elastomeric plastic material such as EDPM or NEOPRENE or the like are mounted on the frame members to bear and seal against the respective inside and outside faces of the glazing panels around the perimter thereof. The outside strips are designed to provide a weather tight seal against air and moisture infiltration between the outside face of the panels and the adjoining adjacent supporting surfaces of the mullions 14 and horizontal frame members 16.

In accordance with the present invention, the horizontal frame members 16 include elongated aluminum extrusions 24 having an upper portion of generally channel-shaped transverse cross-section formed with an upstanding outer wall or face 26 and an upstanding inner wall 28 spaced inwardly thereof. These walls are joined integrally with an outwardly and downwardly sloping bottom wall or web 30 forming a collection trough or gutter for the horizontal frame member. The spacing interval between the walls 26 and 28 is greater than the thickness of the glazing panels 18 that are to be supported by the frame member 16 and adjacent the upper edge portion on the inside surfaces thereof, each wall 26 and 28 is provided with a thickened rib 32 having an elongated slot or keyway **32*a* formed therein for receiving a key-like projection 22*a* of a sealing weatherstrip 22 which is inserted to bear and seal against the adjacent face of the glazing panel. Each thickened rib section on an upstanding channel wall is offset from a respective adjacent lower inside face 26*a* or 28*a* toward the rib on the opposite wall, respectively, as shown best in FIG. 3**.

The outer upstanding wall 26 extends downwardly below the sloped bottom wall 30 and is provided with an enlarged or thickened rib segment 32 along a lower edge similarly having a keyway **32*a* therein adapted to retain a key-like portion 22*a* of a sealing weatherstrip 22**.

Referring specifically to FIG. 3, the elongated horizontal frame member 16 is adapted to be used with a single thickness glazing panel 20 in the rectangular opening below the bottom wall 30 of the member and accordingly, the inner wall 28 is shaped with a downwardly and outwardly sloping segment **28*c* which terminates in a lower rib section 32 along a lower edge. The spacing distance between the opposing faces of the ribs 32 along the lower edges of the inner and outer walls 26 and 28 is less than that between the ribs 32 above the bottom wall 30. This reduced distance is designed to accommodate the reduced thickness of the single thickness panels 20 in comparison with the dual paned, thicker insulating type glazing panels 18. When a single thickness panel 20 is mounted above a dual thickness panel 18, the spacing between opposing rib faces is smaller above the wall 30** than the spacing below.

In the event that dual pane insulating type glazing panels 18 are used both above and below the web 30 of the elongated horizontal frame member 16, a modified lower portion of the frame member 16 (designated by the numeral **28*b* and shown in dotted lines) may be provided to accommodate the increased thickness of a panel 18 used below the web 30**.

Figure 4:
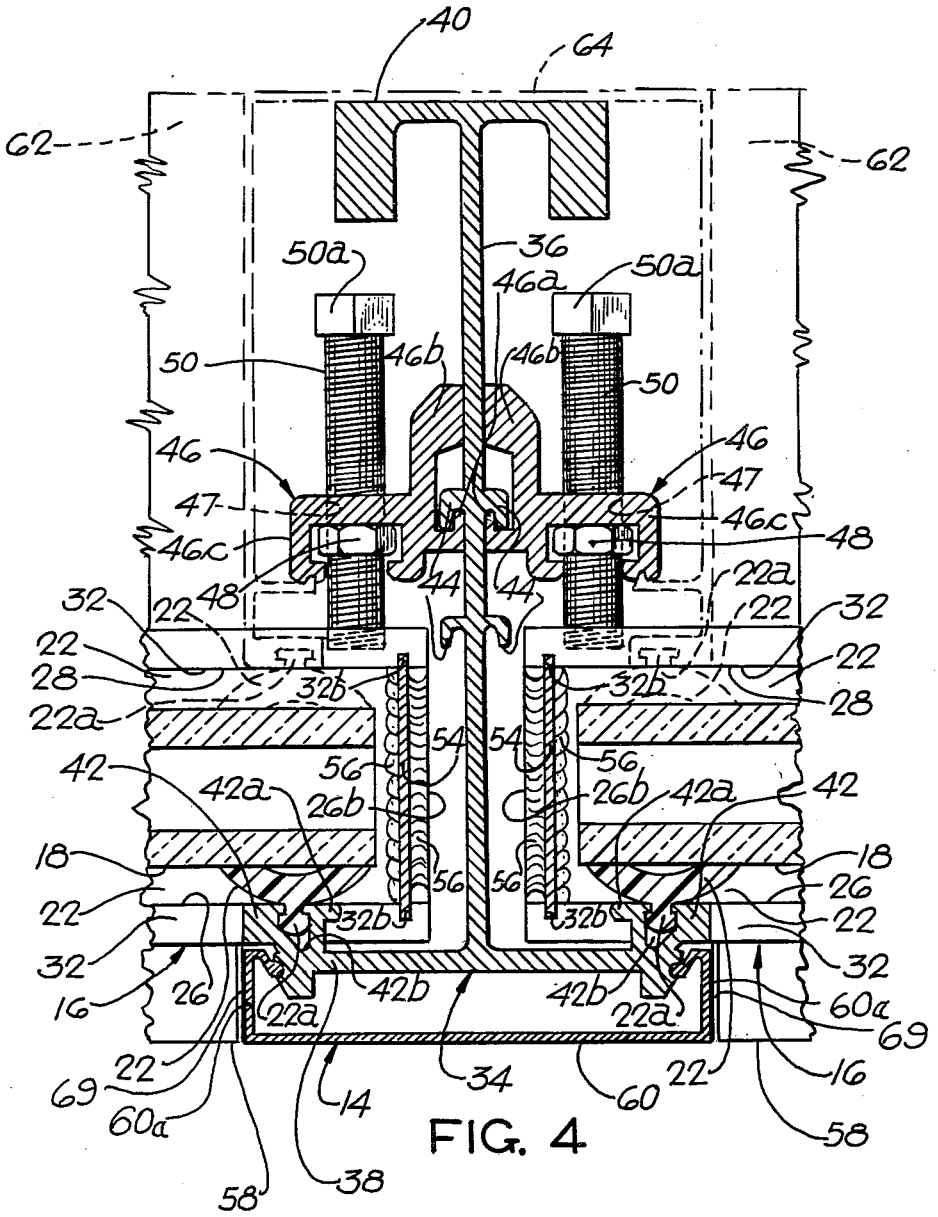
FIG. 4 is a fragmentary, horizontal, cross-sectional view taken substantially along lines 4—4 of FIG. 3.

Referring to FIGS. 2 and 4, the vertical mullions 14 include an elongated structural element 34 of generally I-shaped, transverse cross-section formed of extruded aluminum. The element includes a web 36 having a transverse outer flange 38 along an outer edge and a transverse inner flange 40 along the inner edge as illustrated in FIG. 4. The outer flange 38 is formed with a specially designed transverse cross-section as illustrated and includes heavy rib portions 42 along opposite longitudinal edges of the flange having inside faces **42*a* disposed on a common plane with the inside faces of the rib sections 32 on the outer walls 26 of horizontal frame members 16**.

As illustrated, the rib portions 42 on the vertical outer flange are provided with a keyway-like slot **42*b* in order to accommodate the key-like projections 22*a* on the weatherstrips 22 which bear inwardly and seal against the outer face of the glazing panels 18 to provide weather tight enclosure. The vertical web 36 of the vertical mullion 34 is formed with pairs of parallel spaced apart ribs 44 on opposite faces and these ribs are L-shaped in transverse, cross-section and are positioned to be engaged by support clips 46**, which are preferably formed by cutting off short lengths of an aluminum extrusion.

A clip 46 is mounted on a selected rib 44 of a vertical web 36 at the appropriate level in order to support and secure the abutting end portion of a horizontal frame member 16 and thereby provide the interconnecting rectangular framework for supporting the glazing panels 18 or 20. Each clip includes a toe portion **46*a* adapted to interlock with a rib 44 on the web 36 of the vertical mullion and includes an inwardly extending heel portion 46*b* adapted to bear against the face of the web. Each clip further includes a pair of box-like lateral flange portions 46*c* formed with a channel-shaped cross-section opening and facing toward the glazing panels 18 or 20. A captive nut 48 is mounted in the flange channel and accepts a set screw 50 having a threaded shank adapted to project through a drilled aperture 47 provided in the flange as best shown in FIGS. 3 and 4. Outer ends of the set screws 50 are seated in a groove 28*d* (FIG. 3) formed on the downwardly extending leg 28*b* of the inside wall 28 of the horizontal frame member 24. The set screws 50 are formed with wrench flats 50*a* on the inner ends for use in adjusting their longitudinal positions and biasing the horizontal extrusions 24 outwardly toward the outer flange 38 on the vertical mullion 34. The set screws 50** are provided with means such as plastic inserts or coatings to prevent their loosening.

Referring to FIG. 3, rectangular shaped notches 43 are coped out of the ribs 42 on the flange 38 of the vertical mullion 34 in order to permit the outer walls 26 of the horizontal frame members 16 to run past the outer opposite edges of the vertical flange 38. The ends of the horizontals thus, terminate laterally inwardly of the opposite edges of the vertical flange as illustrated in FIG. 2, by the dotted lines 26*b*. As shown in FIG. 4, the ends 26*b* are spaced apart in parallel relation on opposite sides of the web 36 of the vertical extrusion 34. When the set screws 50 are fully tightened, the horizontal members 24 are biased outwardly until the inner face of the ribs 32 of the upstanding wall 26 are aligned in a common plane with the inner faces 42*a* of the ribs 42 on the vertical outer flange 38 as illustrated.

In accordance with the present invention, the curtain wall structure 10 is provided with a zone dam system for collecting and dispensing any moisture that may happen to infiltrate into the structural framework either from the outside or the inside of the building. The infiltration of moisture during a heavy rain and/or wind storm from the outside sometimes occurs along the weatherstrips 22 at random locations along both vertical and horizontal runs. Leakage may occur between the outside surface of the glazing panels 18 and 20 and/or the weatherstrips or between the weatherstrips and the metal frame members 14 and 16. It is desirable to collect and dispose of any infiltrated moisture at a location as close as possible to the point of original entry and to prevent spreading of collected moisture from one part of the structure into other portions of the curtain wall framework.

Referring to FIGS. 2 and 3, the upper portion of the horizongal frame member 24 is of generally channel-shaped, transverse, cross section and provides a convenient collection trough for moisture infiltrating along the lower edge portion of the glazing panel 18. In order to prevent this collected moisture from spilling out through an open end of the member 24 into the interior of the vertical mullion 14, there is provided one or more zone dam elements 54 of generally rectangular shape and preferably formed of sheet metal. The dams are dimensioned for downward insertion into the upper channel-shaped portion of the horizontal extrusion 24 at a position adjacent one or both ends to extend across the channel between the outer wall 26 and the inner wall 28. The dams 54 have a width dimensioned to provide a slight amount of clearance between the vertical edges thereof and the lower inside faces 26*a* and 28*a* of the opposing extrusion walls, but greater than the spacing between opposing faces of the ribs 32.

In accordance with the invention, pairs of vertical grooves 32*b* are cut into the thickened rib portions 32 above the inside wall faces 26*a* and 28*a* at positions spaced close to the opposite ends of the extrusion. Each pair of opposed grooves provides a keyway for securing a transverse zone dam 54 which is inserted downwardly into position between the wall faces 26*a* and 28*a*. The lower edge of the dam is at right angles to the vertical edges and insertion is complete when the rear corner of the dam contacts the inner edge of the sloped bottom wall 30 as shown in FIG. 3.

After insertion, the rectangular shaped, sheet metal zone dams are sealed with the adjacent surfaces of the vertical walls 26 and 28 and with the sloping bottom or web 30 by means of a bead of extruded caulking or sealant material 56 which is applied conveniently with a caulking gun on opposite side faces of the zone dam as shown in FIG. 4. Insertion of the dams at the ends of the members 24 and the sealing thereof is fast and easy and any infiltrating moisture that is collected in the channel-shaped upper portion of the horizontal member is retained within the length of the member until discharged outwardly to the outside of the building wall structure through weep holes 27 which are drilled at appropriate intervals.

As illustrated in FIGS. 2 and 4, because the opposite end portions of the horizontal extrusions 24 extend past the opposite outer edge of the face flange 38 on the vertical extrusions 34, the zone dams 54 are positioned so that the upper channel of the horizontal frame members 24 may also collect some moisture or rain water which infiltrates along the vertical metal elements, sealing weatherstrips 22 and vertical edge portions of the glazing panels. Because of the dams, any moisture that infiltrates around a particular glazing panel is not transferred into the adjacent frame structure supporting an adjacent panel but, is retained in the channel or trough below the panel until discharge to the outside of the building through the appropriate weep holes 27 is completed. This discharge is generally rapid but can be delayed due to pressure differentials.

As illustrated, the outer wall 26 of the horizontal extrusion 24 may be provided with a snap-on cover 58 of generally channel-shaped cross-section. Moisture collected on the bottom flange of the snap-on horizontal covers flows to the ends for discharge via a small clearance space 69 between the ends and the side face 60*a* of vertical covers 60.

The snap-on cover 60 has a channel-shaped, transverse cross-section and is snapped into place over the outer flange or mullion face 38 of the vertical mullions 34. The outer wall faces of the covers 58 and 60 provide a neatly appearing grid structure for the curtain wall structure 10. Similar inside snap-on covers 62 and 64 may be provided on the inside of the glazing panels of the curtain wall as illustrated in FIGS. 3 and 4.

The zone dam system as described is easy to install and requires a minimum of skill and installation time. The dam members 54 are pre-cut in size to fit easily into the vertical grooves 32*b* which are cut or slotted out in the thickened rib sections 32 of the walls 26 and 28 at a short distance from the ends for receiving and holding the dams 54 in place. Alternatively the dam members 54 may be forced into the upper, channel shaped portion of the horizontal frame members 24, cutting their own vertical grooves in the thickened rib sections 32. The caulking material 56 is applied to seal around the vertical and lower edges on both sides of the dam to establish a water tight dam or seal. The dams 54 need not be trapezoidal in shape to precisely match that of the extrusion but may be rectangular in shape even though the bottom wall 30 is sloped because the caulking material 56 readily fills any gap between the bottom web 30 and the lower horizontal edge of a rectangular dam.

In large, multi-story curtain walls, a dam system of the present invention will prevent the accumulation of excessive large volumes of moisture which otherwise might be channeled after collection to eventually or inadvertently overflow a horizontal member at a lower level. Such overflow could inadvertently occur on the inside of the building or the like and cause extensive problems if not prevented by a zone dam system. In concept, the collected infiltrating moisture is discharged via weep holes to the outside of the building at points relative close to the points of infiltration or seepage and thus, the volume of water present at any particular location in the curtain wall structure is minimized.

Referring now, particularly to FIGS. 5 and 6, therein is illustrated a modified form of horizontal frame member 24A which is adapted to handle single thickness glazing panels 20 installed above the sloping bottom web or wall 30. The upstanding inside wall 28 is spaced relatively close to the outer wall 26 in order to accommodate the single thickness glazing panel 20. In addition, the modified frame member 24A includes a third upstanding wall segment 66 spaced further inwardly of the wall 28. The wall 66, along with an inner portion of the web 30 and the inside face of the wall 28 forms a second, inside collection channel for collecting moisture which may condense and run down over the inside surface of the curtain wall structure, panels, roof, etc.

Zone dams 54 with caulking 56 are provided on this innermost condensation collection channel and this moisture is discharged into the outer collection channel through weep holes 29 which are drilled in the walls 28 at appropriate locations simultaneously with the drilling of the outer weep holes 27. The facing surfaces of the upstanding walls 28 and 66 forming the innermost or inside condensation collection channel are provided with one or more longitudinally extending, relatively small ribs 68 which are generally triangular in transverse cross-section as illustrted in FIG. 6. These ribs have relatively sharp apexes and as the zone dams 54 are inserted downwardly into place, the side edges of the dams themselves are effective to cut small vertical grooves 68*a* in the apex of the ribs. No separate grooving operation or additional tools is required. This grooved engagement functions similar to the grooves 32*b* of the prior embodiment and holds the zone dams firmly in place adjacent the ends of the innermost condensation collection channel. After insertion of the zone dams 54, the caulking material 56 is applied as illustrated to form a water tight seal around the vertical edges and along the bottom for retaining any collected moisture in the condensation collection channel until it is discharged through the weep holes 29 rather than flowing out the ends of the members 24A onto adjacent structure.

Although the present invention has been described with reference to several illustrated embodiments thereof, it should be understood that numerous other modifications and embodiments can be devised by those skilled in the art that will fall within the spirit and scope of the principles of this invention.

What is claimed as new and is desired to be secured by Letters Patent is:

1. A moisture control dam system for curtain wall structures and the like including spaced apart vertical and horizontal frame members forming a framework for supporting at least one wall panel; at least one of said horizontal frame members having a pair of upstanding, spaced apart, inner and outer walls interconnected by a bottom wall forming a channel for receiving a lower edge portion of a wall panel; ribs integrally formed on opposite facing inside surfaces of said inner and outer walls, each rib projecting toward an opposite wall; vertical groove means formed in each of said ribs adjacent at least one end of said horizontal frame member, and a dam having opposite edges inserted in said groove means of said ribs for preventing any accumulated moisture collecting in said channel from running out said one end of said horizontal frame member into another portion of said curtains wall structure.

2. The curtain wall dam system of claim 1 wherein said opposite edges of said dam are spaced apart by a distance greater than the closest distance between said ribs on said inner and outer walls and less than the spacing between said adjacent wall surfaces thereof.

3. The curtain wall dam system of claims 1 or 2 wherein said ribs are formed with means for retaining elongated resilient sealing strips for sealing between said walls and an adjacent face of a wall panel.

4. The curtain wall dam system of claim 1 or 2 wherein said ribs have a transverse cross section with a relatively sharp apex facing the apex of a rib on an opposite wall to form the closest spacing between said ribs on said opposite inner and outer walls of said frame member.

5. The curtain wall dam system of claim 4 wherein said opposite edges of said dam are relatively sharp for forming said vertical groove means in said ribs upon engagement during downward insertion of said dam between said inner and outer walls.

6. The curtain wall dam system of claim 1 or 2 wherein said adjacent wall surfaces of said inner and outer walls are generally parallel and said dam is of rectangular shape.

7. The curtain wall dam system of claim 6 wherein said bottom wall of said channel slopes downwardly toward said outer wall and including a strip of resilient caulking material applied along said opposite edges and a bottom edge of said dam and adjacent portions of said upstanding and bottom walls of said horizontal frame member.

8. The curtain wall dam system of claim 1 or 2 wherein said frame member includes a third upstanding wall spaced inwardly of said inner wall and joined with said bottom wall to form a second channel spaced to the inside of said wall panel for collecting condensation, said upstanding walls forming said second channel having ribs integrally formed on opposite facing surfaces thereof projecting toward one another beyond adjacent wall surfaces integral therewith, vertical groove means formed in said ribs of said second channel adjacent at least one end of said horizontal frame member and a second dam having opposite edges inserted in said groove means in said ribs of said second channel for preventing any accumulated moisture collecting therein from running out said one end of said horizontal frame member.

9. The curtain wall dam system of claim 8 including weep hole means in said inner wall for transfering any moisture collected in said second channel to said first mentioned channel.

10. The curtain wall dam system of claim 9 including weep hole means in said outer wall for discharging any collected moisture from said first mentioned channel toward the outside of said curtain wall structure.

11. The curtain wall of claim 1 or 2 including weep hole means for discharge any collected moisture from said chanel toward the outside of said curtain wall structure.

* * * * *